US006349453B1

(12) United States Patent
Nicoletti et al.

(10) Patent No.: US 6,349,453 B1
(45) Date of Patent: Feb. 26, 2002

(54) CLASP FOR A JEWELRY ITEM

(75) Inventors: Emanuel Nicoletti; Alessia Emanuela Nicoletti, both of Trissino (IT)

(73) Assignee: Orami Gold SRL, Trissino (IT)

( * ) Notice: Subject to any disclaimer, the term of this patent is extended or adjusted under 35 U.S.C. 154(b) by 0 days.

(21) Appl. No.: 09/542,054

(22) Filed: Mar. 31, 2000

(30) Foreign Application Priority Data

Feb. 24, 2000 (IT) ..... VI00A0037

(51) Int. Cl.[7] ..... A44B 11/26; A44C 5/00
(52) U.S. Cl. ..... 24/616; 24/68 J; 24/71 J
(58) Field of Search ..... 24/616, 68 J, 71 J, 24/615, 304

(56) References Cited

U.S. PATENT DOCUMENTS 4,426,854 A * 1/1984 Geldwerth et al. ..... 24/616
4,520,537 A * 6/1985 Valikov ..... 24/616
D344,185 S * 2/1994 Vela ..... D3/318
5,653,009 A * 8/1997 Kassardjian ..... 24/667
5,711,056 A * 1/1998 Taguchi et al. ..... 24/71 J
6,112,373 A * 9/2000 Steinhauer et al. ..... 24/68 J
6,202,268 B1 * 3/2001 Goldstein et al. ..... 24/616

FOREIGN PATENT DOCUMENTS

GB 0162557 * 5/1921 ..... 24/616
GB 0204645 * 10/1923 ..... 24/616
GB 0727643 * 4/1955 ..... 24/71 J

* cited by examiner

*Primary Examiner*—Victor N. Sakran
(74) *Attorney, Agent, or Firm*—Dykema Gossett PLLC

(57) ABSTRACT

An item of jewelry having an having an essentially linear construction made of swivel elements linked together to produce a closed loop by connecting first and second end pieces belonging to opposite ends, wherein a clasp thereof includes a pin attached to the first end piece and passes through a hole belonging to the second end piece, at least one end of the pin having a swelling (enlarged end) suited to snapping into a safety clip provided with intrinsic elasticity and rotatably coupled to the first or to the second end piece.

7 Claims, 2 Drawing Sheets

CLASP FOR A JEWELRY ITEM

BACKGROUND OF THE INVENTION

1. Field of the Invention

The invention concerns a simplified clasp for items of jewelry or costume jewelry produced with linked elements suited for instance to produce bracelets or necklaces.

2. The Prior Art

According to known techniques both bracelets and necklaces, or likewise any items that have a closed loop form, are fastened to the arm of whoever wears them by mechanical devices called "clasps". These clasps basically consist of a box with a slot that holds a male member, which works together with the connecting devices in the box and makes a firm connection of the two ends of the linked item.

There are various types of clasps, but it can be said that every clasp essentially has a female member with a basically boxed construction, being rather complicated to produce, and a male member with a tongue that fits into the slot in t he female member. The production of clasps is quite intricate because it involves several stages of processing such as for example blanking, bending and soldering the boxed female member and other processes for the male member. What's more, both the female fastener and the male piece have to be soldered or somehow attached to the ends of the linked elements that they have to fasten. Besides, since various work cycles have to be carried out on the clasp, such as for instance soldering the various pieces, and since the jewelry, and especially the goldsmith sector which employs these clasps, demands a high quality finish, it is understandable that the processing of the clasps requires the commitment of specialist personnel and also considerable time to work and refine the finish of the clasp.

The main object of this invention is to dramatically eliminate work time on the clasp, proposing a simplified clasp that nevertheless achieves the same scopes of known clasps.

One of the objects of this invention is also for the proposed clasp to be a very reliable fastener, that resists well to tugs and opening whether by accident or due to acts of violence.

Another object that the invention intends to achieve is that the proposed clasp is easy to use and can even be handled by a just one hand so that the user can open and close the clasp without the help of another person, as is the case for instance with bracelets where one hand is blocked since it has to be kept still to receive the actual bracelet.

Another object that it intends to achieve is to drastically reduce the cost of the clasp and its production time.

Yet another object is to produce a clasp as effective as any made from known techniques and that actually weighs considerably less than known clasps. The reason for this second need is evident especially in clasps made of precious metals, where the lighter weight of the product is an essential condition for keeping down the cost of the item, this being an important factor for it's success on the market.

SUMMARY OF THE INVENTION

All the aforementioned objects and others that shall be better explained below are achieved by a clasp for items of jewelry having an essentially linear construction made of swivel elements linked together to produce a closed loop by connecting first and second end pieces belonging to opposite ends of the item where the clasp is characterised in that it includes a pin attached to the first end piece through a hole belonging to the second end piece, at least one end of the pin having a swelling suited to snapping into a safety clip provided with intrinsic elasticity and rotably coupled on said first or said second end piece.

One advantage of this invention is that the so-called box of the clasp, in other words the female part, has now been completely eliminated with the device invention being replaced, as will be seen below, by a spring clip that works together with the male part made, under this invention, of the swollen tip of a pin. Additional characteristics and details of the invention shall be better explained in the description of two preferred forms of execution of the invention given as a guideline but not a limitation, illustrated in the attached drawings.

DETAILED DESCRIPTION OF THE PREFERRED EMBODIMENT

Figure 1:
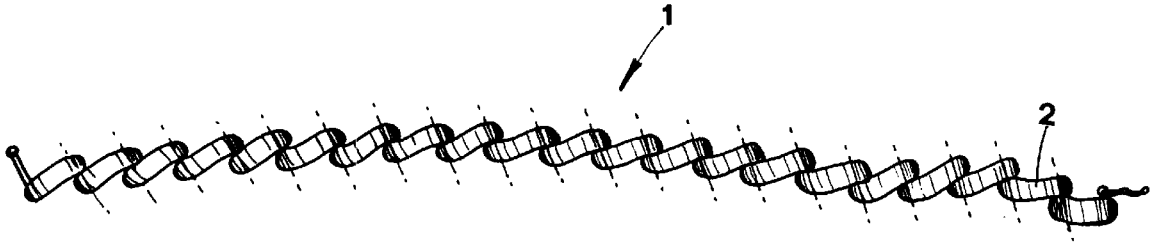
FIG. 1 illustrates a typical example of a linked chain suited to producing a bracelet with the clasp invention.
Figure 2:
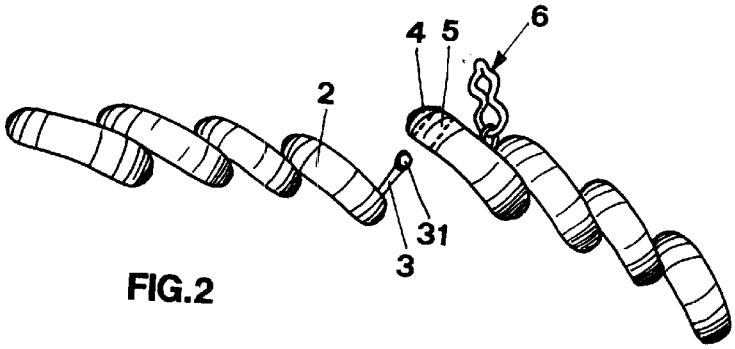
FIG. 2 shows the end pieces before being joined together.

With reference to the above figures, a bracelet with the clasp invention can be seen in FIG. 1, indicated by 1. FIG. 2 shows how the first end piece 2 has a pin 3 soldered to it, having a swollen tip 31 produced for instance by partially melting the tip of the pin under a flame. The second end piece of the bracelet 1, indicated by 4, has a hole 5 with a large enough diameter to allow the entry of swollen tip 31 and therefore also the pin 3. The second end piece 4 also has an elastic element indicated by 6 that is a clip shaped in the form of a figure of eight and is provided with intrinsic elasticity so that the widening 61 can flex apart to receive the knob 31 and then close back over it in order to prevent the spring clip 6 and pin 3 from detaching, if not due to an intentional action of the user by a lifting movement that gives rise to the deformation.

Figure 2A:
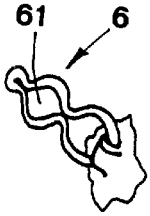
FIG. 2*a* shows a detail of FIG. 2.

It should be noted that the spring clip 6 in the shape shown in FIG. 2*a* is already known in the jewelry sector, although it is known as a safety element used in conjunction with known clasps and is in fact also called a "safety clasp" or simply "figure of eight", because of its shape. In effect, it is quite common that known types of clasps can easily open by themselves after extensive use. So the clasp produced as it is, according to known techniques, is sometimes aided by the addition of this "safety clasp" made of the clip 6 and by a knob soldered on the box of the traditional clasp in order to create an additional safety element.

As can be seen, with the case in question the clasp's box has been eliminated, and instead, in a new and original manner, a part of the safety clasp is used, and in other words the spring clip 6, this time working together with a specific pin having the function of the clasp's male member.

Figure 3:
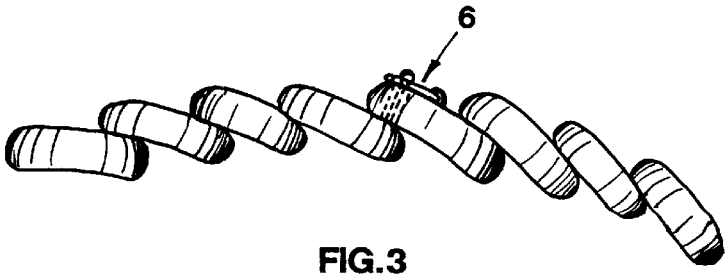
FIG. 3 shows the end pieces joined together by the clasp invention.

In fact, as can be seen in FIG. 3, when the pin 3 enters the hole 5 belonging to the second end piece 4 the swollen part 31 comes out of the hole 5 so that the spring clip 6 can be clipped onto the end piece 31 and complete the intended fastening. It is already understandable how the construction of the clasp invention has been extremely simplified, since for this purpose it is quite enough to provide a pin with a swollen tip and a shaped spring clip of extremely simple construction and most certainly does not require lengthy processes and costly finishing.

The clasp invention, in the form shown in FIGS. 1 to 3, assumes that the first and second end pieces that are fastened together overlap at least to their sides.

Figure 4:
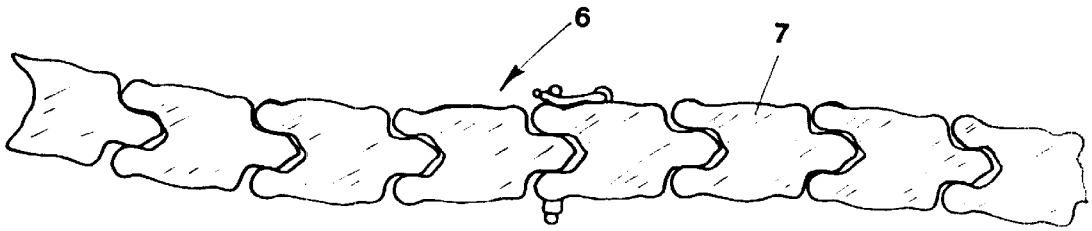
FIG. 4 shows another example of a chain with linked elements that are interlocked one over another.
Figure 5:
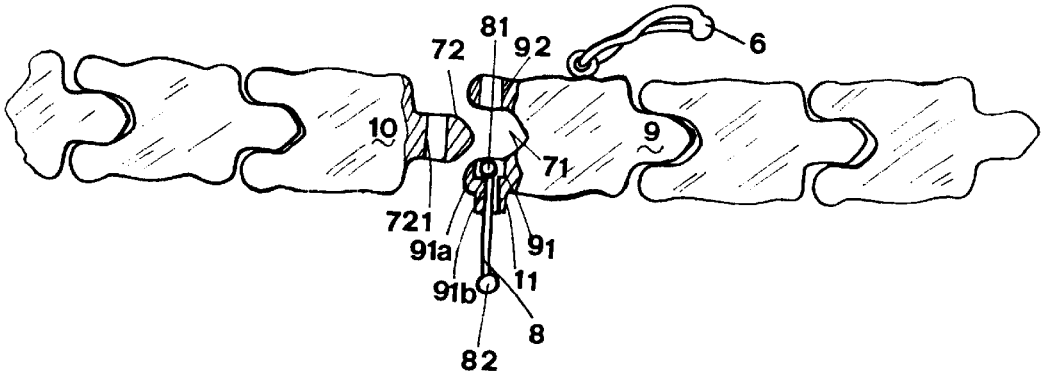
FIG. 5 shows the end pieces before being joined together by the clasp invention.
Figure 6:
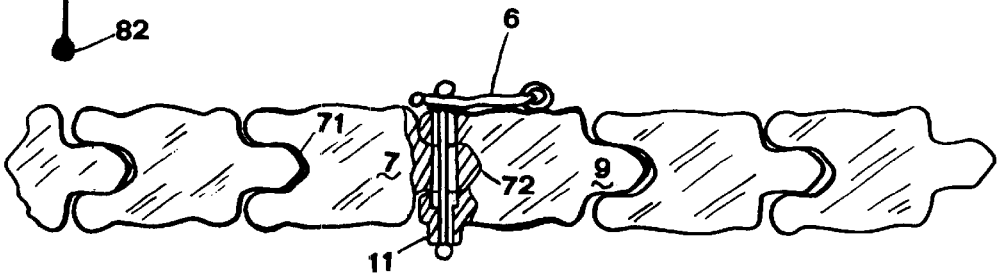
FIG. 6 shows the end pieces now joined together by the clasp invention.

On the contrary, FIGS. 4 to 6 show how the clasp invention can effectively be used even for linked elements that are interlocked together like those seen in FIG. 4. FIG. 4 shows a bracelet 70 that has elements 7 all identical, linked together and each having a female part indicated by 71 that is a cavity in the element 7 and a male part indicated by 72 that, when the elements are linked together, fits into the female part 71.

Figure 5A:
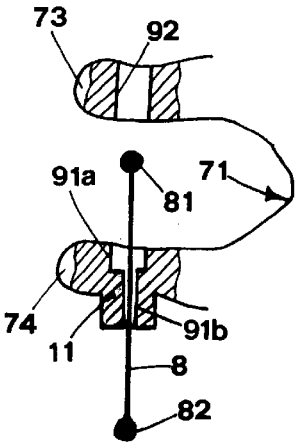
FIG. 5*a* is an enlarged detail of part of FIG. 5.

FIG. 5 and also FIG. 5*a* show a case where the pin 8 is held in the first end piece indicated by 9 that has a hole cutting crossways through the cavity 71 that can be defined as a first hole 91 and a second hole 92 coaxial with each other belonging to the first lobe 73 and the second lobe 74 defining the cavity 71. The first hole 91 has two diameters, one larger indicated by 91*a* and one smaller indicated by 91*b*. The second hole 92 has the same diameter as part 91*a* of hole 91. The pin 8 has two beads at its two ends, one indicated by 81 and the other indicated by 82. The bead 81 is sized so that it sits in hole 91*a* without difficulty but its diameter is greater than hole 91*b*; in this way the pin 8 cannot come out of the first hole 91. In fact there is an additional swelling or knob 82 on the other end of the pin 8, and therefore the pin 8 cannot come out of the first end piece 9. In the second end piece 10 there is a hole 721 in the male section 72 with a large enough diameter to allow the bead 81 to pass through it, so that when part 72 of the male end piece 10 fits into the cavity 71, the pin 8, as can be seen in FIG. 6, can pass through hole 721 and hole 92 until it juts out to connect with the spring clip 6, now mounted on the first end piece 9.

Since most linked elements 7 are hollow, if the pin 8 is not adequately directed it has difficulty in finding the hole 92 and pass through it. To avoid this inconvenience, the example in question has been provided with a soldered guide tube 11 as can be seen in FIGS. 5 and 6, so that the pin 8 is always guided in a vertical direction thereby passing through the hole 92 to clip onto the spring clip 6 without difficulty.

It can be seen that the clasp invention can be used even in these types of linked elements. The only difference to the first example is that in this case the pin 8 is sliding and not fixed to the first end piece.

The description given amply proves the simplicity of construction of the clasp proposed under this invention and also the simplicity of its connection with the first and second end pieces, as this merely requires a hole in the second end piece for the pin to pass through and set a spring clip on the first or second end piece, as the case requires.

Therefore, according to the invention, all the lengthy and costly constructions of the clasp's box and its male member are avoided, the actual clasp is made lighter since the pin with spring clip together weigh substantially less than any kind of traditional clasp and all the finishing processes are eliminated besides the construction of the clasps according to methods conforming to former craft. The result is that, even though the clasp invention ensures absolute reliability and safety, its manufacturing cost and weight are unequivocally lower than clasps from known crafts.

What is claimed is:

1. A clasp for linking opposite ends of an item of jewelry, said clasp comprising first and second end pieces, said first end piece providing a cavity between first and second projections that have respective first and second holes therethrough which are aligned with one another, said first hole having a first portion with smaller diameter than a second portion; said second end piece defining a male part which is positionable in said cavity, said male part including a third hole therethrough which is aligned with said first and second holes when said male part is positioned in said cavity; a pin having enlarged ends which is movably positioned in said first hole and is slidable through said third hole and said second hole to extend beyond said second projection; and an elastic safety clip rotatably attached to one of said first and second end pieces to snap fit over an enlarged end of said pin when extending beyond said second projection.

2. A clasp according to claim 1, wherein the enlarged end at a first end of said pin stops out of said first piece substantially in proximity of the smaller hole, the enlarged end of a second end snapping onto the safety clip rotatably coupled to said first piece.

3. A clasp according to claim 1, wherein said pin has at least one tube coaxial with the first hole, so that said pin is guided into said second hole.

4. A clasp according to claim 3, wherein said tube is exterior to the cavity of said first end piece.

5. A clasp according to claim 1, wherein the enlarged end on at least one end of said pin is a bead soldered onto the pin.

6. A clasp according to claim 1, wherein the safety clip provided with intrinsic elasticity is made of a closed loop of metal wire shaped in an "8".

7. An item of jewelry formed of swivel elements linked together to provide an essentially linear construction having opposite first and second end pieces that can be moved together to form the item of jewelry into a closed loop, said first end piece providing a cavity between first and second projections that have respective first and second holes therethrough which are aligned with one another, first hole having a first portion with smaller diameter than a second portion; said second end piece defining a male part which is positionable in said cavity, said male part including a third hole therethrough which is aligned with said first and second holes when said male part is positioned in said cavity; a pin having enlarged ends which is movably positioned in said first hole and is slidable through said third hole and said second hole to extend beyond said second projection; and an elastic safety clip rotatably attached to one of said first and second end pieces to snap fit over an enlarged end of said pin when extending beyond said second projection.

* * * * *